US008366314B2

(12) United States Patent
Marti

(10) Patent No.: US 8,366,314 B2
(45) Date of Patent: Feb. 5, 2013

(54) MANUAL DEVICE FOR ADJUSTING AND/OR CONTROLLING A FUNCTION OF A TIMEPIECE

(75) Inventor: Philippe Marti, Colombier (CH)

(73) Assignee: G. & F. Châtelain SA, La Chaux-de-Fonds (CH)

( * ) Notice: Subject to any disclaimer, the term of this patent is extended or adjusted under 35 U.S.C. 154(b) by 295 days.

(21) Appl. No.: 12/859,685

(22) Filed: Aug. 19, 2010

(65) Prior Publication Data

US 2011/0044140 A1 Feb. 24, 2011

(30) Foreign Application Priority Data

Aug. 19, 2009 (FR) ..... 09 55707

(51) Int. Cl.
*G04B 37/00* (2006.01)
*G04B 29/00* (2006.01)

(52) U.S. Cl. ..... 368/308; 368/319

(58) Field of Classification Search ..... 368/306, 368/319, 308, 320–321
See application file for complete search history.

(56) References Cited

U.S. PATENT DOCUMENTS 4,313,187 A * 1/1982 Waki et al. ..... 368/319
5,257,247 A * 10/1993 Miche et al. ..... 368/290
5,383,166 A * 1/1995 Gallay ..... 368/288
6,980,488 B2 * 12/2005 Schneider ..... 368/37
7,025,494 B2 * 4/2006 Oomori et al. ..... 368/190
7,175,341 B2 * 2/2007 Oomori et al. ..... 368/308
7,862,226 B2 * 1/2011 Bracher et al. ..... 368/190
2005/0249051 A1 * 11/2005 Cogoli et al. ..... 368/319

FOREIGN PATENT DOCUMENTS

EP 0 736 823 A 10/1996
FR 2 783 939 A 3/2000

* cited by examiner

*Primary Examiner* — Sean Kayes
(74) *Attorney, Agent, or Firm* — Frommer Lawrence & Haug LLP; Ronald R. Santucci

(57) ABSTRACT

Manual device for adjusting and/or controlling a function of a timepiece comprising a case 2 housing a horological movement, said manual device comprising a rod 3 and a retractable crown 4 mounted in said case, and such that the crown comprises a cylindrical body 16 having a blind cylindrical hollow 5 surrounding a tubular passage 6 designed to surround said rod 3 and connect it kinematically in rotation to the crown 4, at least one elastically deformable means 8 pushing the crown outwards relative to the case 2, the device comprising a base 10 in the shape of a cylindrical cover designed to be fixed into the watch case and traversed by said rod 3, and an indexing structure 11, 12, 13, 14, 15 attached to said base and making it possible to index an indexing ring 15 coupled translationally, but free in rotation, to the end of said tubular passage 6 of the crown, and making it possible, via successive applications of pressure to the crown, to move from a retracted or rest position to a working position.

12 Claims, 9 Drawing Sheets

MANUAL DEVICE FOR ADJUSTING AND/OR CONTROLLING A FUNCTION OF A TIMEPIECE

This application claims priority benefits of French Patent Application Number 09 55707 filed Aug. 19, 2009, the disclosure of which is incorporated herein by reference.

The present invention relates to horology. It concerns in particular a manual device for adjusting and/or controlling a function of a timepiece comprising a case housing a horological movement, said manual device comprising a rod and a retractable crown mounted in said case.

BACKGROUND OF THE INVENTION

In horology, the part normally used for adjusting the main functions of a timepiece is called the crown. In a watch, the crown is usually mounted on the side of the watch middle, the middle being the part containing the system which enables the time to be displayed on the dial.

There are in addition two major classes of time-measuring system used in horology for mounting in timepieces, specifically in watch cases. On the one hand are electronic systems, known as quartz movements, which are usually battery-powered and comprise a quartz oscillator and electronic components mounted in an electronic circuit which measures and displays the time accurately. On the other hand are mechanical systems which are usually self-powered, requiring the use of no battery and generally having a spring, termed the hairspring, and a number of mechanical components, chiefly gears, mounted in a mechanical system known as the movement. Generally speaking the crown is for adjusting, activating or deactivating the functions of the movement of a timepiece, usually by means of a rod which connects it kinematically to the movement of the timepiece.

The invention applies particularly to mechanical watches comprising a crown for adjusting and/or controlling the movement. In a mechanical watch the case is the assembly composed of the case back, the middle and the part that provides the connection between the case and the watch crystal, which is known as the bezel.

DESCRIPTION OF THE PRIOR ART

In most models of mechanical watches, and even certain models of quartz watches, the crown is generally mounted on the side of the watch middle. Also, most commercially sold models of mechanical watches comprise an adjusting and/or controlling crown whose position is identical regardless of the watch model and is located generally next to the 3-o'clock position on the watch dial. Furthermore, in most watch models the crown usually projects fully from the watch middle to enable the user to manipulate the crown.

However, the fact that the crown is mounted on the side of the watch middle and projects is not without its problems.

Thus, in a wristwatch, the fact that the crown projects and is fixed against the side of the middle creates a weak spot should the watch be knocked against a hard surface. Knocks, which can occur in all sorts of accidents, can leave the crown bent and even sometimes broken. This is due to the fact that the crown is usually connected to the watch movement only by a very thin rod. Thus, a lateral knock on the crown can bend it. When the rod is bent it goes without saying that the crown can no longer adjust or control the watch movement in any way at all.

Another problem that occurs is due to the fact that if poorly handled, a projecting crown can catch on all sorts of objects, such as clothes, bracelets, or any other kind of jewelry which may be worn on the wrist. This may be uncomfortable for the user. Moreover, as a rule, and in order to give an adequate grip, crowns usually have striations in the form of sharp edges which can chafe against garments placed in contact with them.

Again, another problem that can occur arises from the inconvenience occasioned by the mere presence of the crown itself. Specifically, when the crown projects, it forms a sort of stud that can, during certain wrist movements, rub against the user's skin. This can also be uncomfortable for the user.

Finally, another problem is connected with the aesthetics of the timepiece, specifically the watch. The problem is that a projecting crown creates a sort of protuberance within the circular structure of the watch case. By interrupting the continuity of the circular structure of the watch, this protuberance greatly detracts from its aesthetics.

Various solutions to the prior art teach different systems designed to strengthen the mounting of the crown on the case.

One solution is to machine a screw thread on the case and screw the crown into it. This solution has the advantage of securing the crown more strongly to the case but, because the crown still projects and is mounted more or less flush to the case, it does not prevent it from being bent or broken if knocked. Moreover, when the user wishes to adjust the movement he must first unscrew the crown, and it is only once the crown has been completely unscrewed that the user can position the crown correctly for adjusting or controlling the movement. This solution detracts from the ease of use of the crown. A locking mechanism of this kind is described for example in document FR 2 783 939.

A second solution is to fit a device that enables the crown to be retracted completely into the case. Such a device is described in French Patent Application FR 2 030 095. The mechanism comprises spring stop arms 11 which, when pressure is applied, move apart and become immobilized against a ring 9. The mechanism still has certain defects. In the first place, it is conceivable that after prolonged use the spring arms will lose their elasticity, which would leave the crown no longer properly immobilized. Secondly, the immobilizing ring can become worn during prolonged use and this would also mean that it was no longer properly immobilized.

A first object of the invention is therefore to provide an adjustment and/or control device that makes it possible to fasten the crown to the watch so that the latter can no longer be bent or broken. A second object of the invention is to provide an adjustment and/or control device that ensures that it cannot catch on objects or chafe garments. A third object of the invention is to provide an adjustment device that does not detract from the aesthetics of the watch. A fourth object of the invention is to provide an adjustment and/or control device that is less affected by possible wear to the internal components of the device and that immobilizes the crown properly throughout the life of the watch.

SUMMARY OF THE INVENTION

In accordance with the invention, these various objects are achieved by means of an adjustment and/or control device comprising a case housing a horological movement, said manual device comprising a rod and a retractable crown mounted in said case, in which device the crown comprises a cylindrical body having a blind cylindrical hollow surrounding a tubular passage designed to surround said rod and connect it kinematically in rotation to the crown, at least one elastically deformable means pushing the crown outwards relative to the case, the device comprising a base in the shape of a cylindrical cover designed to be fixed into the watch case and traversed by said rod, and an indexing structure attached to the base and making it possible to index an indexing ring coupled translationally, but free in rotation, to the end of said tubular passage of the crown and making it possible, via successive applications of pressure to the crown, to move from a retracted position termed the rest position to a working position.

According to the invention, the indexing structure may comprise a notched ring at one of its ends, connected to said base, and a notched tube at one of its ends, connected to the base and axially separated from the notched ring, said notched tube having axial ribs on its inside surface; the ring and the notched tube are arranged in such a way that the notches are face to face and angularly offset; and the indexing ring has studs on its lateral surface so that in one indexing position it is able to slide inside the notched tube and in another indexing position remain blocked by the notched end of the notched tube.

According to the invention, the adjustment and/or control device may be fixed in a housing recessed radially into the watch case.

According to the invention, the adjustment and/or control device may alternatively be fixed in a housing recessed perpendicularly to the bezel of the watch case.

According to the invention, the watch case may be provided with at least one push button acting on a yoke that indexes a horological movement-function selection bridge.

According to the invention, the watch case may be provided with two push buttons acting on first and second yokes, respectively, allowing indexing of a horological movement-function selection bridge between two positions when the crown is in the working position.

According to the invention, the crown may be provided with a plunger element acting on the horological movement-function selection bridge to return it and maintain it in a neutral position when the crown moves from the working position to the rest position.

DESCRIPTION OF THE DRAWINGS

The features of the invention will become more clearly apparent to those skilled in the art on reading the following description of several embodiments offered purely as examples, without implying any limitation, with reference to the diagrammatic figures in which.

DESCRIPTION OF THE PREFERRED EMBODIMENTS

Figure 1:
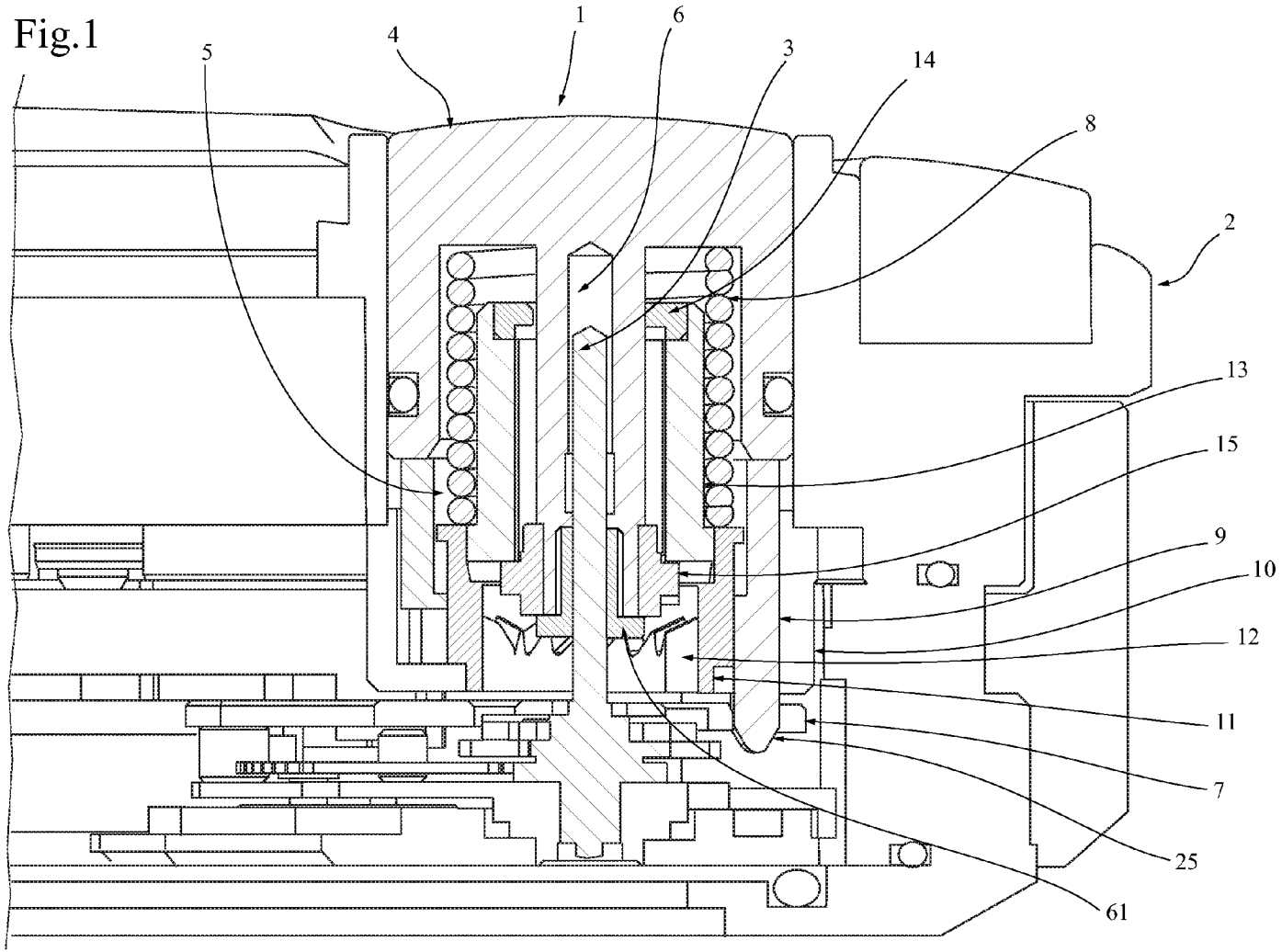
FIG. 1 is a cross section through the adjustment device according to the invention.

FIG. 1 is a cross section through a first embodiment of an adjustment and/or control device according to the invention. The device 1 comprises a rod 3 and a retractable crown 4 and is fixed in a housing recessed perpendicularly into a watch case 2. The retractable crown 4 comprises a cylindrical body having a blind cylindrical hollow 5 surrounding a tubular passage 6 designed to surround said rod 3 and connect it kinematically in rotation to the retractable crown 4. The rod 3, which is of square or polygonal section, is housed at one end in the tubular passage 6 while the other end of the rod 3 is housed in a movement-function selection bridge 7 which allows the rotations of the rod to be transmitted into the watch movement. The cross section of the tubular passage 6 may preferably be square or polygonal. In this instance the lower part of the passage is provided with a screw 61 that has a passage of square or polygonal section complementary to that of the rod 3, providing the kinematic connection in rotation between the rod 3 and the crown 4. Housed in the cylindrical hollow 5 is a first spring 8 for pushing the crown 4 outwards from a rest position, in which the crown is completely retracted inside the watch case and no control or adjustment of the movement is possible, to a working position in which the crown projects above the surface of the watch and the watch movement can be controlled or adjusted. The process allowing the movement from the rest position to the working position will be described in more detail in the course of the description. The crown also comprises a plunger 9 with a conical end which, when the crown 4 is in the rest position, fits in a hole 25 provided for this purpose in the movement-function selection bridge 7. In FIG. 1, the adjustment and/or control device according to the invention is shown in the rest position and the plunger 9 is sitting in the hole 25 provided for this purpose in the movement-function selection bridge 7, which neutralizes any adjustment or control of the movement. This is described in more detail with reference to FIGS. 3-5.

The adjustment and/or control device further comprises a base 10 in the form of a cylindrical cover fixed inside the case 2 by means of two screws (not shown), a milled tube 11, preferably laser-welded to the inside of the base 10, a notched ring 12, preferably laser-welded to the inside of the milled tube 11, a notched tube 13, preferably also laser-welded to the inside of the milled tube 11, a stop ring 14, preferably laser-welded to the top end of the notched tube 13, and an indexing ring 15 capable of pivoting and sliding inside the notched tube 13 as the retractable crown moves from the rest position to the working position.

Figure 2:
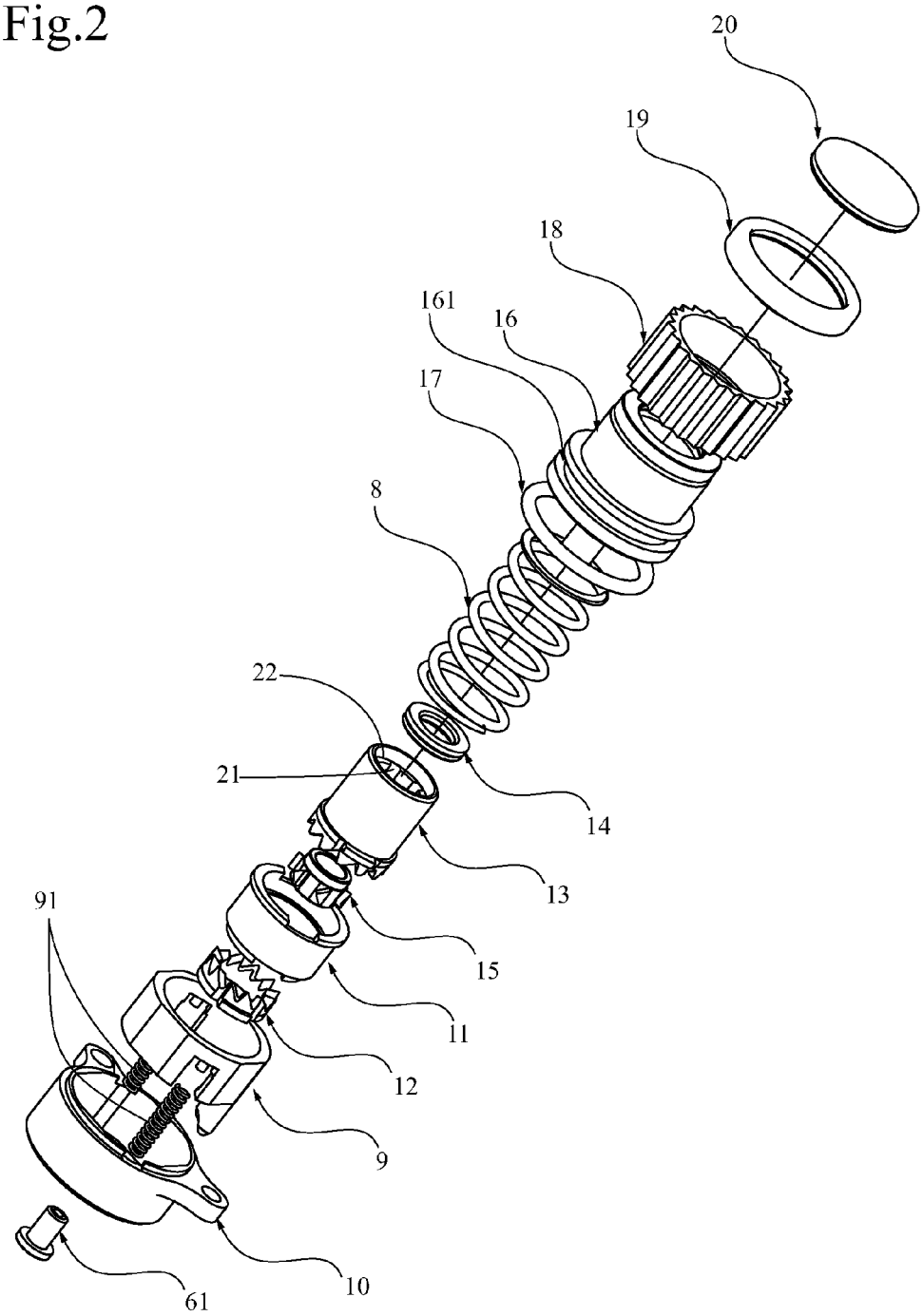
FIG. 2 is an exploded view of the retractable crown.

In FIG. 1 the crown is shown in a simplified form. FIG. 2 shows the retractable crown in an exploded view for greater clarity. The retractable crown 4 comprises a cylindrical body 16 inside which the blind cylindrical hollow 5 provides a housing for the spring 8, an O-ring 17 housed in a lateral annular kerf 161, a ring 18, a cap 19, and a ceramic cover piece 20. Furthermore, the plunger 9 is positioned on a pair of springs 91 that move the plunger 9 when the crown moves from the rest position to the working position. On the inside of the notched tube 13 are grooves 21 and ribs cut in such a way that the indexing ring 15 can slide inside the notched tube 13. Lastly, the retractable crown comprises a screw 61 with a hollow interior machined to be complementary to the cross section of the rod 3 so that the rod 3 can pass through it. The screw 61 is screwed into the lower end of the tubular passage 6 and enables the indexing ring 15 to be coupled translationally to the retractable crown 4 when the latter moves from the rest position to the working position and allows the crown 4 and the rod 3 to be connected kinematically rotationally.

The operation of the retractable crown will now be described in detail with reference to FIGS. 3-5.

Figure 3:
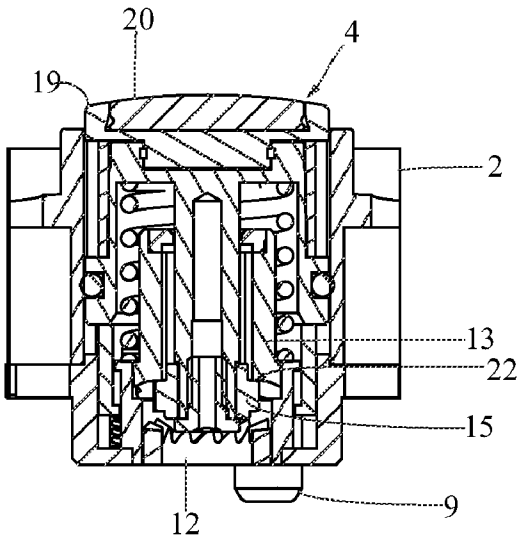
FIG. 3 is a cross section through the retractable crown when the latter is in the rest position.

FIG. 3 is a cross section through the retractable crown 4 when the latter is in the rest position. In the rest position, the crown is almost entirely retracted within the case 2. Only the top of the crown, consisting of the cover piece 20 and the upper part of the cap 19, extends above the upper surface of the bezel of the case 2. The bottom of the crown meanwhile is completely retracted within the case 2. In this rest position the teeth of the indexing ring 15 are blocked by the ribs 22 of the notched tube 13. In the rest position, the teeth of the indexing ring 15 are therefore facing the ribs 22 of the notched tube 13, which prevents the indexing ring 15 from rising inside the notched tube 13. As can also be seen, in the rest position the plunger 9 extends beyond the bottom of the retractable crown and sits inside a hole 25 present for this purpose in the movement-function selection bridge 7, neutralizing any adjustment or control of the watch movement. The neutralization of the movement function bridge 7 by the plunger 9 will be described in more detail in relation to FIGS. 10A-10D.

Figure 4:
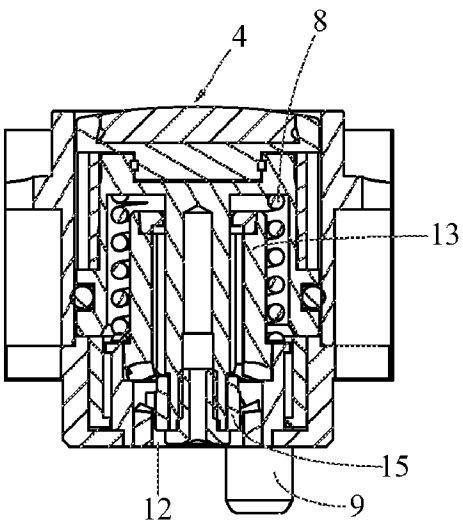
FIG. 4 is a cross section through the retractable crown when the latter is in a low position.

FIG. 4 is a view in axial section through the retractable crown 4 when the latter is in the low position. When the crown is in the rest position and the user depresses it, the springs 8 and 91 compress and the crown 4 first moves into the low position in which it is completely retracted within the case 2. The springs are depressed and the plunger 9 is as far as it can go into the hole 25 provided for this purpose in the movement-function selection bridge 7. In the low position the teeth of the indexing ring 15 index against the teeth of the notched ring 12, making the indexing ring 15 turn. This process of movement between the rest position and the working position will be described in more detail with reference to FIGS. 6-8.

Figure 5:
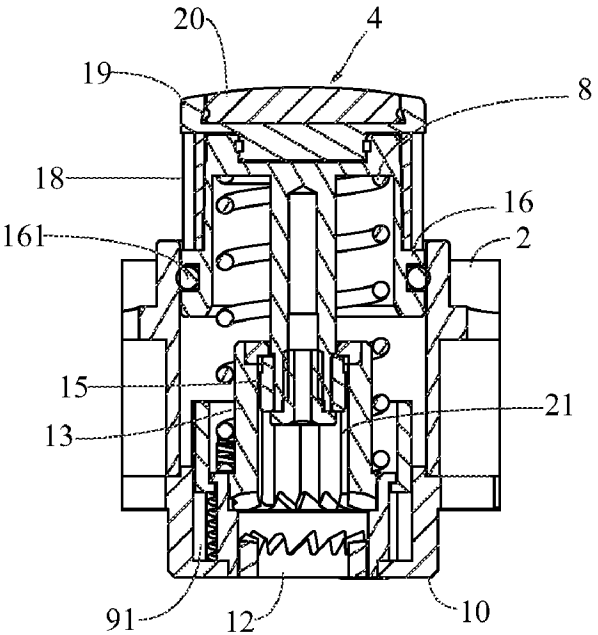
FIG. 5 is a cross section through the retractable crown when the latter is in the working position.

FIG. 5 is a view on an axial section through the retractable crown 4 when the latter is in the working position. In this position the springs 8 and 91 are relaxed and the crown is projecting from the case. In addition the indexing ring 15 has slid along the grooves 21 of the notched tube 13 and has been stopped by the stop ring 14. Also, owing to the action of the springs 91, the plunger 9 is raised, releasing the movement-function selection bridge 7, thus allowing the watch movement to be adjusted or controlled.

The process of moving from the rest position in which the crown 4 is retracted within the case 2, to the working position, in which the crown 4 is projecting from the bezel of the case, will now be described in more detail with reference to FIGS. 6-8.

Figure 6:
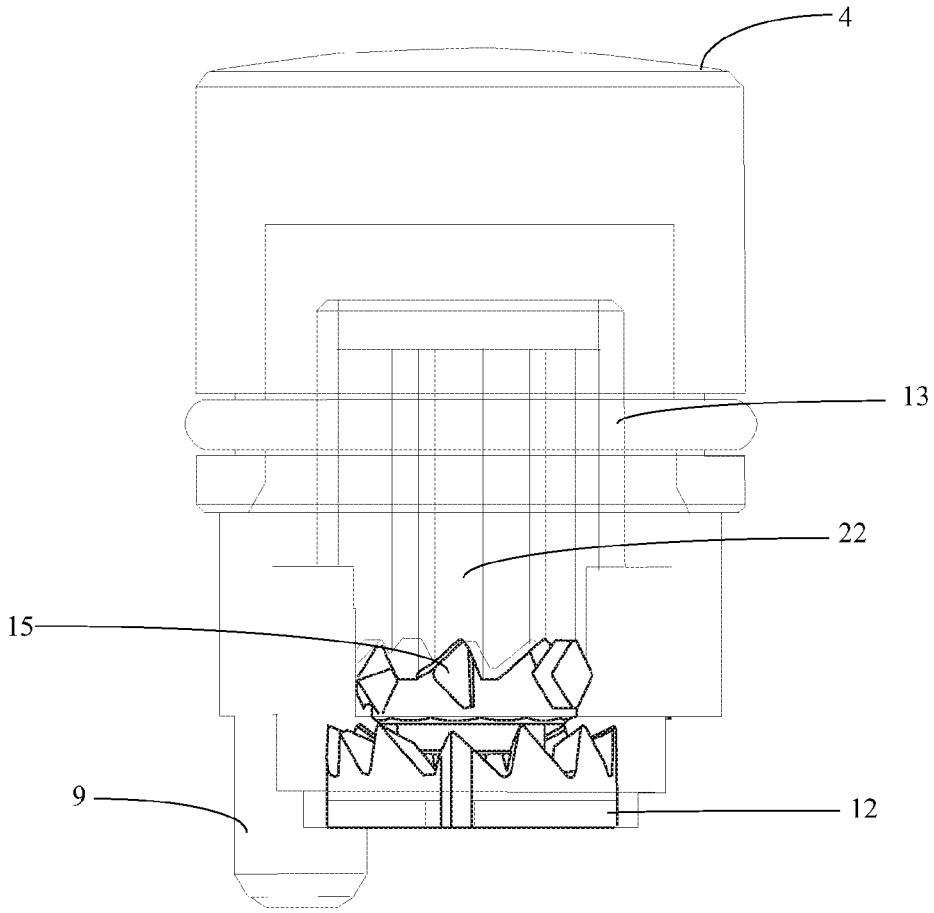
FIG. 6 is a see-through view of the retractable crown when the latter is in the rest position.

FIG. 6 shows the retractable crown 4 in the rest position. The teeth of the indexing ring 15 are facing the ribs 22 of the notched tube 13, preventing the indexing ring 15 from rising inside this tube 13. In the rest position the plunger 9 extends beyond the lower part of the base 10 and immobilizes the movement-function selection bridge 7 by sitting in a hole 25 provided for this purpose in the movement-function selection bridge 7. In the rest position, no adjustment or control of the movement is possible.

Figure 7:
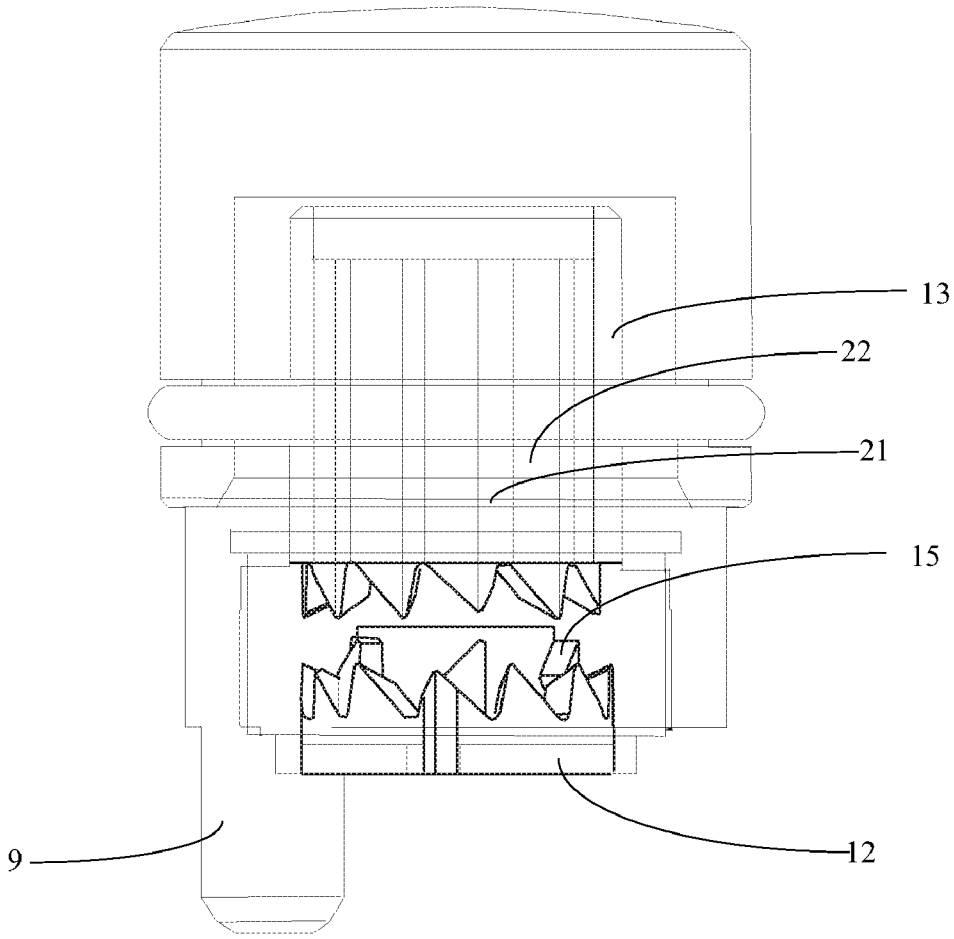
FIG. 7 is a see-through view of the retractable crown when the latter is in the low position.

FIG. 7 shows the retractable crown 4 in the low position when the user depresses the crown, which was previously either in the rest position or in the working position. In the low position the plunger 9 extends to its furthest point beyond the base 10, thus contributing to return the movement-function selection bridge 7 to a neutral position.

In the rest position, following pressure applied to the crown 4 by the user, the teeth of the indexing ring 15 index with the teeth of the notched ring 12. Because of the triangular shape of the teeth of the indexing ring 15 and of the teeth of the notched ring 12, and because of the misalignment between the teeth of the indexing ring 15 and those of the notched ring 12, when the indexing ring 15 teeth index with those of the notched ring 12, this causes a first rotation of the indexing ring 15. Consequently, the indexing ring 15 teeth, which when the crown was in the rest position faced the ribs 22 of the notched tube 13, are no longer exactly facing the ribs 22 following this first rotation. Then, when the user releases the pressure on the crown, the springs 8, 91 (not shown) help to push the crown 4 back upwards. The teeth on the indexing ring 15 then index against the teeth on the notched tube 13, causing a second rotation of the indexing ring and thus helping to position the teeth of the indexing ring 15 in the grooves 21 of the notched tube 13. The indexing ring 15 can then slide in inside the notched tube 13 to rejoin the upper end of the notched tube 13 and be immobilized against the stop ring 14. The crown is now in the working position.

Figure 8:
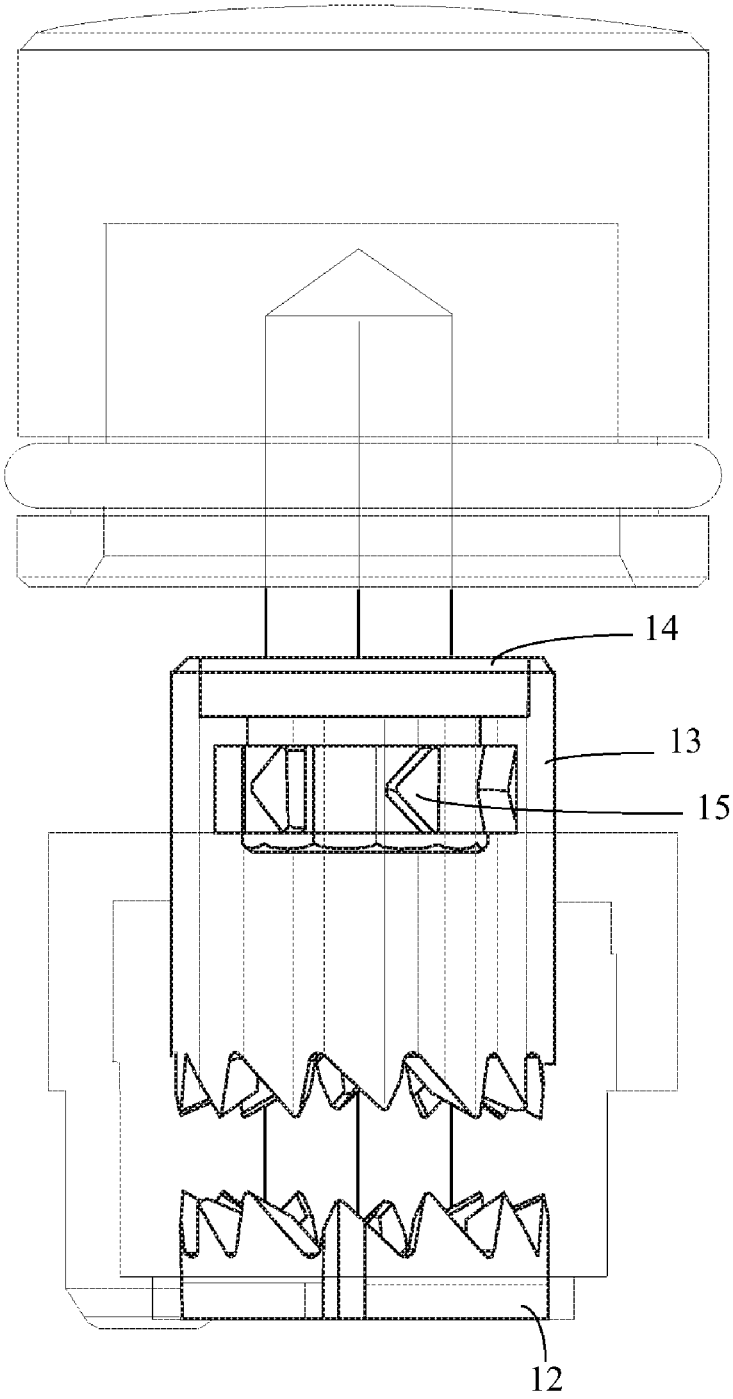
FIG. 8 is a see-through view of the retractable crown when the latter is in the working position.

FIG. 8 shows the retractable crown 4 when the latter is in the working position. In this position the teeth on the indexing ring 15 have slid along the inside of the grooves 21 of the notched tube 13 and the indexing ring 15 is now immobilized against the stop ring 14. The plunger 9 is completely raised and leaves the movement-function selection bridge 7 completely free, and the crown 4 is immobilized in the working position. This position allows the watch movement to be adjusted or commands to be given, on the one hand by activating one of the pushers 29 (shown in FIG. 11), and on the other hand by rotating the crown in either direction depending on the adjustment procedure for that particular watch movement, which will be described later.

From the working position shown in FIG. 8, the crown is retracted into the rest position in the following manner.

When the user depresses the crown, the indexing ring 15 slides along the inside of the notched tube 13 as far as its lower end until it is in the low position. On passing through the low position, the teeth on the indexing ring 15 index the teeth on the notched ring 12, causing the indexing ring 15 to perform a first rotation. The teeth on the indexing ring 15 are therefore not exactly facing the grooves 21 of the notched tube 13. Next, when the user releases the pressure on the crown, the teeth on the indexing ring 15 index the teeth on the notched tube 13, which causes a second rotation of the indexing ring and positions the teeth of the indexing ring 15 against the ribs 22 of the notched tube 13. The indexing ring is henceforth immobilized against the lower end of the notched tube 13 and the crown is in the rest position.

Figure 9:
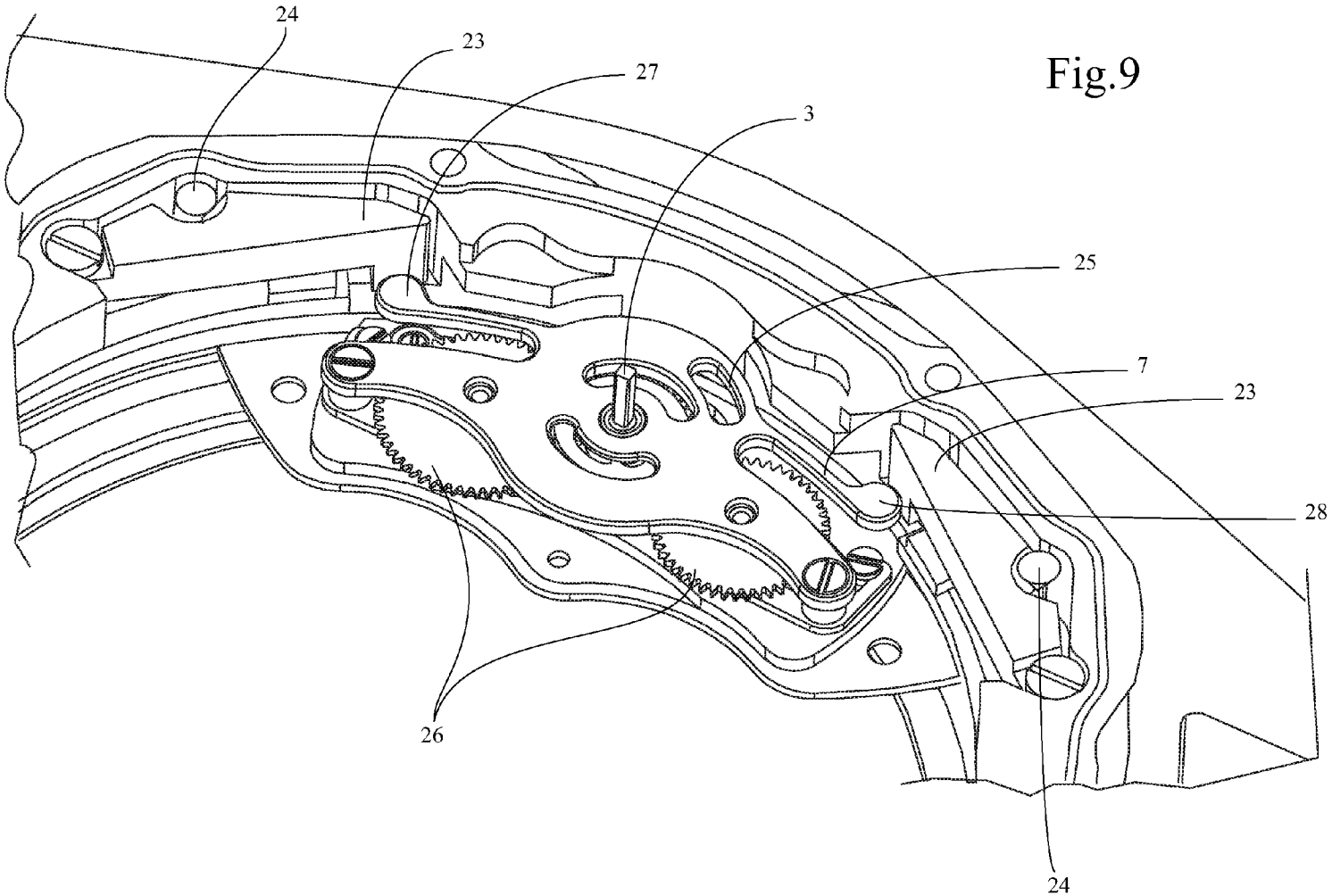
FIG. 9 is a top view of the movement-function selection bridge.

FIG. 9 is a top view of the movement-function selection bridge without the retractable crown.

Mounted in the case 2 are a plurality of yokes 23 which, on the basis of pressure applied by the user to the pushers 29 (shown in FIG. 11) allow the yokes 23 to be moved in order to adjust or control the watch movement. The watch pushers act on the yokes 23 via rods with a conical end. For clarity, only the conical lower end 24 of these rods is shown in FIG. 9.

In a preferred embodiment, the rod 3 is square-sectioned, but it is also conceivable for the rod to have a more generally polygonal cross section. The rod 3 is fixed in the selection bridge 7 which contains a hole 25 for receiving the plunger 9 when the crown is in the low position or rest position, and two spring arms 27, 28.

In a preferred embodiment, two pushers 29 (shown in FIG. 11) are mounted on the case, one facing the position marking 2-o'clock on the watch dial and the other facing the position marking 4-o'clock on the watch dial. These pushers therefore act on the yokes 23 and may also comprise several springs. When the user applies pressure to one or other of the pushers 29 and when the crown 4 is in the working position, the conical end 24 of the rod associated with the pusher on which the user has pressed moves down into a hole machined in the corresponding yoke. This prompts a rotary movement of the yoke which in turn prompts a rotary movement of the movement-function selection bridge 7 and allows the horological movement to be adjusted by means of the gears 26, according to an adjustment and/or control procedure specific to the watch movement. However, when the crown is in the working position but the user has not pressed on any of the pushers 29, the selection bridge 7 and the yokes 23 are in the neutral position and nothing happens when the user turns the crown.

Figure 10A:
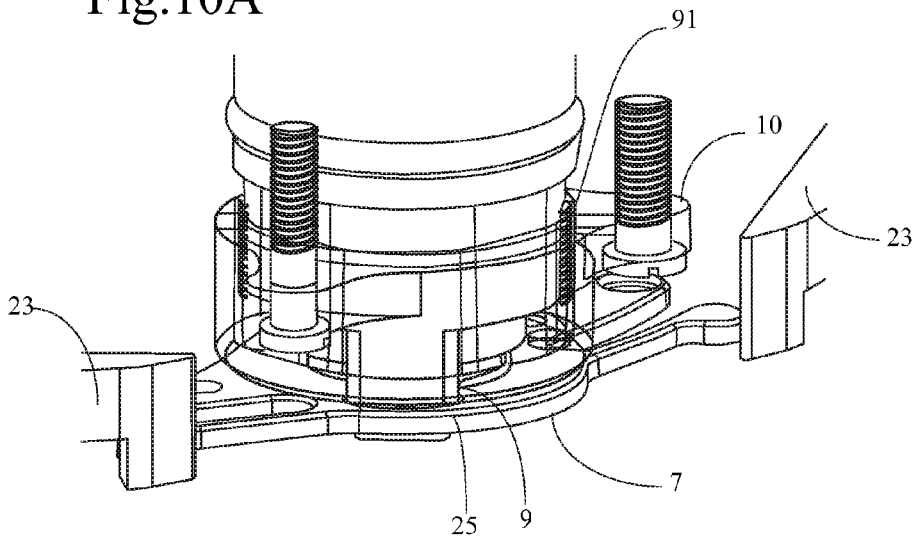
FIG. 10A is a see-through view of the retractable crown and of the movement-function selection bridge when the crown is in the rest position.

FIG. 10A is a see-through view of the plunger element 9 when the crown 4 is in the rest position.

In the rest position the plunger 9 prevents any movement of the movement-function selection bridge 7. As described above, in the rest position the crown 4 is retracted and the conical end of the plunger is housed in the hole 25 provided for this purpose on the movement-function selection bridge 7. The bridge is in the neutral position and the gears 26 of the movement-function selection bridge 7 are not in contact with the horological movement.

The fact that in the rest position the plunger 9 neutralizes any movement of the movement-function selection bridge 7 also saves the energy of the horological movement and extends its power reserve. Specifically, in the rest position the movement-function selection bridge 7 is in the neutral position and its gears 26 are inactive. There is therefore no friction between the gears 26 and those of the movement and therefore no loss of energy at this point.

Figure 10B:
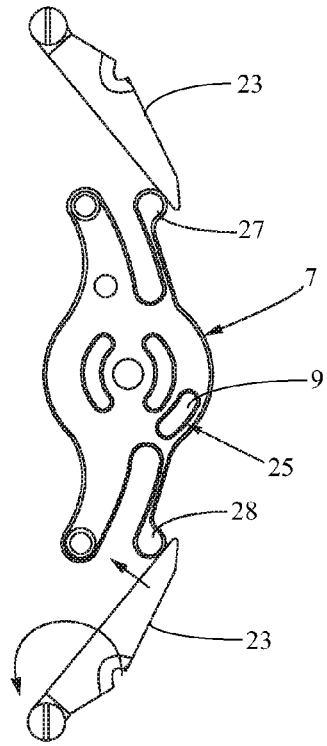
FIG. 10B is a top view of the movement-function selection bridge.

FIG. 10B is a diagrammatic view of the movement-function selection bridge 7 when the crown 4 is in the rest position. The plunger 9 is housed in the hole 25 of the movement-function selection bridge 7 and prevents it rotating. Should one of the pushers 29 be activated, one of the spring arms 27, 28 of the movement-function selection bridge 7 will deform and prevent the latter from rotating.

Figure 10C:
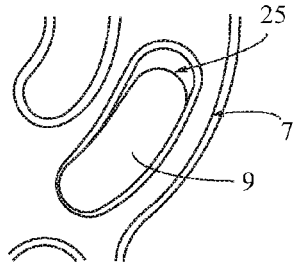
FIG. 10C is a diagrammatic view of the plunger and of the movement-function selection bridge when the crown is in the working position and it has made an adjustment.

FIG. 10C shows a diagrammatic view of the plunger 9 when the crown 4 is in the working position and pressure has been applied to one of the pushers 29. At this instant the plunger is no longer completely opposite the hole 25 in the bridge 7.

Figure 10D:
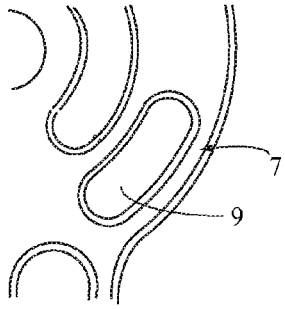
FIG. 10D is a diagrammatic view of the plunger and of the movement-function selection bridge when the crown is in the low or rest position.

FIG. 10D is a diagrammatic view of the plunger 9 when the crown 4 is in the low position. The conical end of the plunger 9 moves into the hole 25 of the bridge 7, helping to return the bridge to the neutral position. Thus, when the user releases the pressure on the crown, the bridge is in the neutral position and the plunger is housed in the hole. As described before, the crown 4 is disengaged at this instant and all the gears 26 of the bridge 7 are now inactive, which helps to conserve the energy of the movement and extend the power reserve. Movement from the working position to the rest position and vice versa is always through the low position. In all instances the movement through the low position therefore enables the movement-function selection bridge 7 to be returned to the neutral position.

Figure 11:
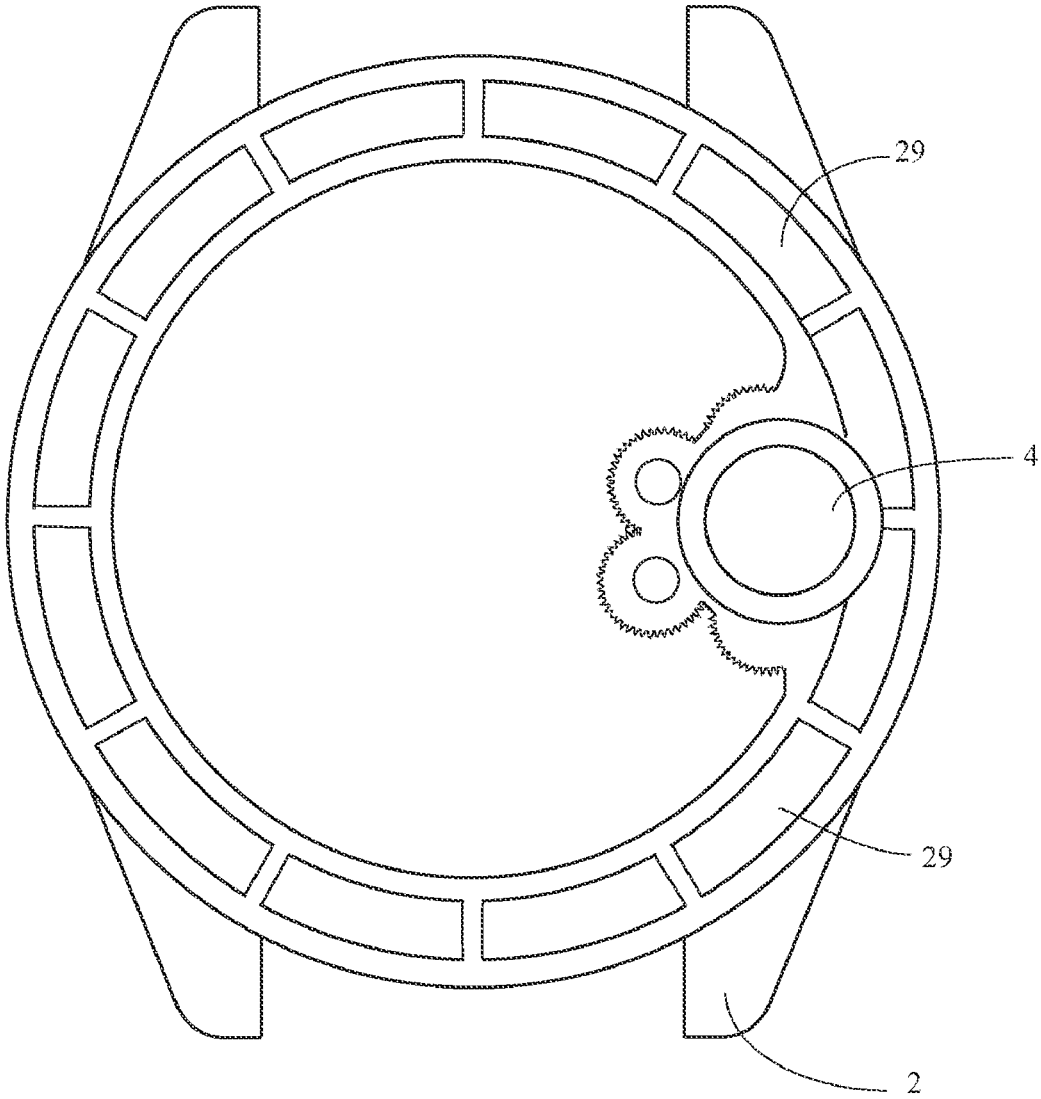
FIG. 11 is a top view of an embodiment in which the crown is fixed in a housing located in the bezel of a watch case.

FIG. 11 is a top view of the first embodiment of the adjustment and/or control device according to the invention in which the adjustment and/or control device 1 is fitted to the upper face of a watch case 2, in other words on the dial side. In addition to the usual components, the watch case comprises a retractable adjustment and/or control crown 4 and one or more pushers 29. The watch case 2 preferably comprises two pushers 29, one of which is next to the 2-o'clock position on the watch dial and the other next to the 4-o'clock position.

In another embodiment it is also possible for the adjustment device to be mounted in a housing recessed into the middle, radially with respect to the watch case.

In the description given above of the first embodiment, the adjustment and/or control device is mounted in a mechanical watch. It is also conceivable for the adjustment device to be more generally mounted in a timepiece, especially a clock, an alarm clock, or any other mechanical timepiece.

With the control and/or adjustment device according to the invention, the adjustment crown is retracted most of the time and cannot be bent or broken.

Moreover, with the control and/or adjustment device according to the invention, the crown does not project and cannot damage clothes or jewelry.

The adjustment and/or control device according to the invention also eliminates the discomfort occasioned by the presence of a projecting crown.

Lastly, because the crown is retracted for most of the time, the adjustment and/or control device according to the invention does not break the continuity of the circular structure of the watch and thus contributes greatly to improving the aesthetics of the watch.

The invention claimed is:

1. Manual device for adjusting and/or controlling a function of a timepiece comprising a case (2) housing a horological movement, said manual device comprising a rod (3) and a retractable crown (4) mounted in said case, in which manual device the crown comprises a cylindrical body (16) having a blind cylindrical hollow (5) surrounding a tubular passage (6), the tubular passage (6) designed to surround said rod (3) and connect the rod (3) kinematically in rotation to the crown (4), at least one elastically deformable means (8) to urge the crown outwards relative to the case (2), a base (10) in the shape of a cylindrical cover designed to be fixed into the case and traversed by said rod (3), and an indexing structure (11, 12, 13, 14, 15) attached to said base (10) to index an indexing ring (15) coupled translationally, but free in rotation, to an end of said tubular passage (6) of the crown, wherein the indexing ring (15) is caused to rotate and alternate between a rest position and a working position upon each successive application of pressure to depress the crown.

2. The manual device as claimed in claim 1, in which the indexing structure comprises a first notched ring (12) connected to said base (10), and a second notched tube (13) connected to the base (10) and axially separated from the first notched ring (12), said second notched tube (13) having axial ribs (22) on an inside surface thereof;

wherein the first notched ring (12) and the second notched tube (13) are arranged in such a way that notches in the first notched ring are face to face and angularly offset from notches in the second notched ring; and wherein the indexing ring (15) has studs on a lateral surface so that in a first indexing position the indexing ring is able to slide in translational movement inside the second notched tube (13) and in a second indexing position the indexing ring is blocked from translational movement by the notched end of the second notched tube (13).

3. The manual device as claimed in claim 2, wherein the manual device is fixed in a housing recessed radially into the case.

4. The manual device as claimed in claim 2, wherein the manual device is fixed in a housing recessed perpendicularly to a bezel of the case.

5. The manual device as claimed in claim 2, in which the case (2) is provided with at least one push button (29) acting on a yoke (23) that indexes a horological movement-function selection bridge (7).

6. The manual device as claimed in claim 1, wherein the manual device is fixed in a housing recessed radially into the case.

7. The manual device as claimed in claim 6, in which the case (2) is provided with at least one push button (29) acting on a yoke (23) that indexes a horological movement-function selection bridge (7).

8. The manual device as claimed in claim 1, wherein the manual device is fixed in a housing recessed perpendicularly to a bezel of the case.

9. The manual device as claimed in claim 8, in which the case (2) is provided with two push buttons (29) acting on first and second yokes (23), respectively, the respective push buttons enabled to cause indexing of a horological movement-function selection bridge (7) between two positions when the crown is in the working position.

10. The manual device as claimed in claim 9, in which the crown is provided with a plunger element (9) acting on the horological movement-function selection bridge (7) to return the horological movement-function selection bridge and maintain the horological movement-function selection bridge in a neutral position when the crown moves from the working position to the rest position.

11. The manual device as claimed in claim 8, in which the case (2) is provided with at least one push button (29) acting on a yoke (23) that indexes a horological movement-function selection bridge (7).

12. The manual device as claimed in claim 1, in which the case (2) is provided with at least one push button (29) acting on a yoke (23) that indexes a horological movement-function selection bridge (7).

* * * * *